United States Patent [19]

Crane, Jr.

[11] 4,437,935

[45] Mar. 20, 1984

[54] METHOD AND APPARATUS FOR PROVIDING SECURITY FEATURES IN PAPER

[75] Inventor: Frederick G. Crane, Jr., Dalton, Mass.

[73] Assignee: Crane and Company, Dalton, Mass.

[21] Appl. No.: 269,850

[22] Filed: Jun. 3, 1981

[51] Int. Cl.[3] ..... D21D 3/00; D21H 5/10

[52] U.S. Cl. ..... 162/103; 162/105; 162/108; 162/140

[58] Field of Search ..... 162/140, 103, 105, 108, 162/145, 146, 104; 428/915, 916

[56] References Cited

U.S. PATENT DOCUMENTS

| | | | |
|---|---|---|---|
| 2,017,339 | 10/1935 | Bryant et al. | 162/108 |
| 2,143,406 | 1/1939 | Chamberlain | 162/140 |
| 3,691,009 | 9/1972 | Opderbeck et al. | 162/146 |
| 3,853,695 | 12/1974 | Back et al. | 162/104 |
| 3,880,706 | 4/1975 | Williams | 162/140 |
| 3,892,622 | 7/1975 | Skaugen | 162/108 |
| 4,250,217 | 2/1981 | Greenaway | 428/916 |
| 4,304,809 | 12/1981 | Moraw et al. | 428/916 |

FOREIGN PATENT DOCUMENTS

| | | | |
|---|---|---|---|
| 1365876 | 9/1974 | United Kingdom | 162/140 |

OTHER PUBLICATIONS

Dobrowolski et al., "Optical Interference Coatings for Inhibiting of Counterfeiting", Optica Acta vol. 20, No. 2, 12/73.

*Primary Examiner*—Peter Chin

[57] ABSTRACT

A security device is integrally combined with the fibres of the paper in a paper-making process. A carrier web of water-dispersible fibres carrying the security element is brought into contact with the paper stock during the paper-making process. The carrier web becomes rapidly dispersed upon contact with the wet stock leaving the security element firmly attached to the paper fibres in the stock. In one embodiment, the security element comprises a plastic diffraction grating structure. In a further embodiment, the carrier web comprises an open porous structure for enhancing intermixing with the paper stock.

2 Claims, 10 Drawing Figures

METHOD AND APPARATUS FOR PROVIDING SECURITY FEATURES IN PAPER

BACKGROUND OF THE INVENTION

U.S. Pat. No. 2,379,443 discloses a variety of methods for rendering paper which is identifiable for protection against counterfeiting. The patent describes the use of colored fibres and fluorescent fibres for distinguishing between the identifiable paper and ordinary paper. The patent discloses a method of incorporating chemically-treated paper which change color upon subsequent treatment.

U.S. Pat. No. 3,880,706 discloses a method of manufacturing identifiable paper by incorporating a thermoplastic material by fusing the thermoplastic to the paper fibres during the paper-making process. Plastic dots of various colors can be incorporated within the paper fibres by the method of this patent.

Also known is the use of fine plastic security thread within the paper structure. However, when security elements of exteemely fine detail, such as a diffraction grating structure, are to be employed high temperatures must be avoided in order not to distort the fine detail of the security element.

The purpose of this invention is to provide methods and apparatus for incorporating security devices having fine detail or distinctively treated fibres within a paper web during the paper-making process without the requirement of heating the device to cause it to adhere to the paper.

SUMMARY OF THE INVENTION

Security devices are incorporated in the paper during the paper-making process by using a carrier web to support the security device during the paper formation on the paper machine. Said carrier web is water dispersable so that it will disperse during the paper forming process, its fibres becoming part of the ensuing paper and the security device remaining within the ensuing paper in its desired location.

Another method employs carrier web having an open, porous structure with sufficient wet strength to maintain its integrity during the paper forming process to which the security device has been attached by means of adhesive so that the carrier web will become a part of the ensuing paper and will provide an anchor to secure the device within the paper. The carrier web may contain a plurality of low temperature heat seal fibres or a heat seal sizing which may be used to attach the device to the carrier web.

DESCRIPTION OF THE PREFERRED EMBODIMENT

Figure 1:
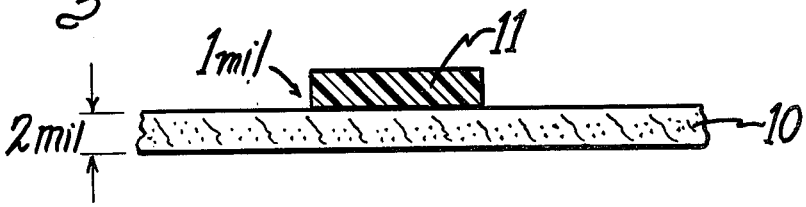
FIG. 1 is a cross section of the security device attached to the carrier web for inserting the device according to the invention.
Figure 2:
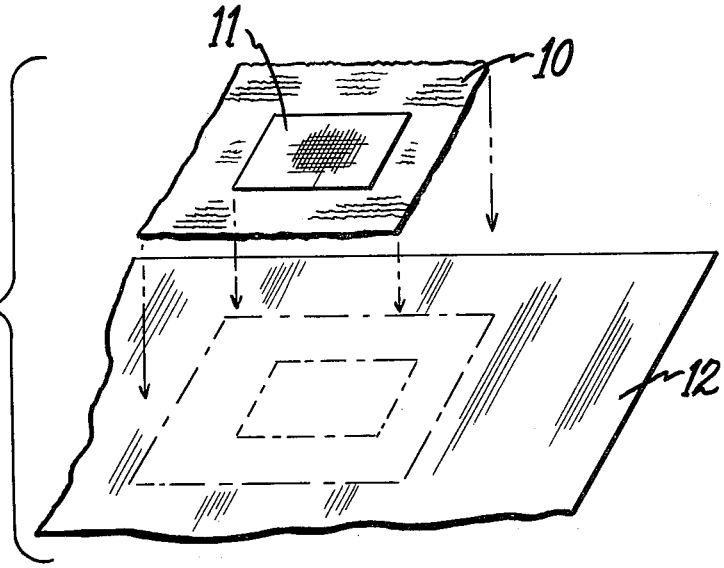
FIG. 2 is a top view in isometric projection showing the carrier paper web containing the sefurity device prior to contact with a base paper web.
Figure 3:
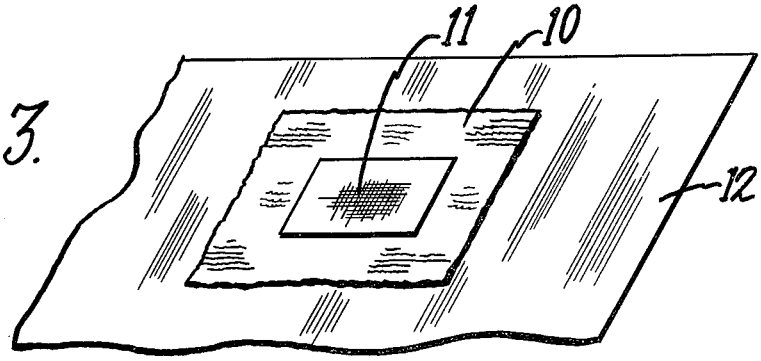
FIG. 3 is a top view of the base paper web shown in FIG. 2 with th carrier paper web dispersed therein.
Figure 4:
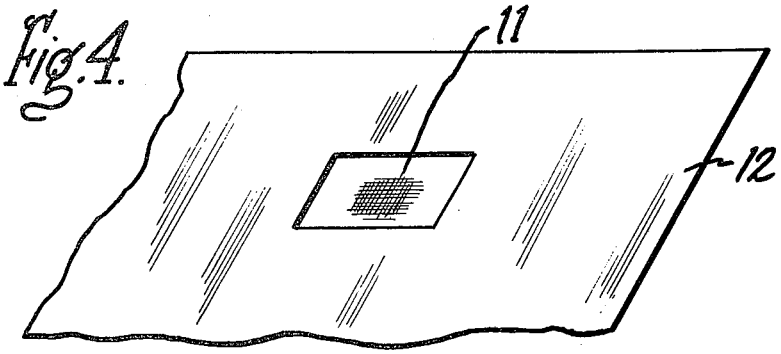
FIG. 4 is a top view of the security device of the invention formed within the base paper web of FIG. 3 after dispersion of the carrier paper web.

One method of providing a security feature to a paper for authenticating purposes and to prevent copying consists of the use of a carrier web (10) such as shown in FIG. 1. The security element (11) is first attached to a carrier web (10) which can be formed in an open and porous manner. The resulting carrier web (10) containing the security device (11) is inserted into the paper forming area prior to the actual formation of the paper (12) as shown in FIG. 2 in such a manner that the exact location of the security device (11) can be precisely controlled in all directions. When the paper containing security device (11) needs to be authenticated as genuine, such as currency or other valuable documents, the security device (11) can comprise a diffraction grating structure. Security device when in the form of diffraction grating structure will present different colors or patterns to the viewer depending upon the angle of incident light. The carrier web (10) which can be made in an open and porous fashion so that it will readily allow the formation of paper wround it, is used for handling and attaching security device (11) to surrounding base paper (12) which is formed in a conventional paper making process. Security device (11) is attached to carrier paper web (10) by pressing security device (11) onto the surface of carrier paper web (10) with sufficient heat to activate a heat seal fibre or applying a non-water soluble adhesive between security device (11) and carrier web (10). The registration of carrier paper web (10) to a predetermined position on the surface of base paper web (12) insures that security device (11) will be at a predetermined position when brought into contact with bse paper web (12). This is an important feature of the invention, since security device (11) must quite often be found at a specific location on the surface of the paper. The attachment between security device (11), carrier paper web. (10) and base paper web (12) is shown in FIG. 1 immediately before and FIG. 3 shortly after contact. The water contained within base paper web (12) immediately causes the fibres comprising carrier paper web (10) to disintegrate such that security device (11) simultaneously attaches to the fibres which comprise base paper web (12) as shown in FIG. 4.

Figure 5:
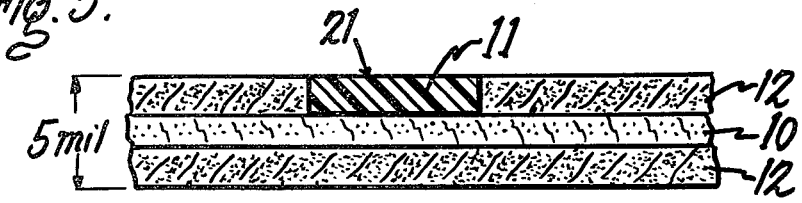
FIG. 5 is a cross section view showing the finished paper with the carrier web with the device attached to it inserted in the base paper.

FIG. 5 shows one method for arranging security device (11) within a base paper (12). Carrier web (10), having security device (11) attached in a manner similar to that shown in FIG. 1, is fabricated from an open, porous web having a density of less than 0.6 grams per cubic centimeter. This is indicated in FIG. 5 by spaced fots 19 which represent the carrier paper fibres. Base paper (12) having a less porous web density of 0.6–0.9 gms/cc similar to that of banknote paper, is represented by dots 20 which characterize the base paper fibres. The method of placing carrier web (10) on base web (12) is similar to that for the water dispersible carrier web (10) of FIG. 9. However carrier web (10) of FIG. 5 is not water dispersible. Upon insertion into base web (12), fibres 20 in base web (12) deposit upon fibres (19) in carrier web (10) and become intimately formed therewith during the remaining stages of the paper making process. In order for security device (11) to remain near the surface of base web (12), exposed for (21) of security device (11) is coated with a hydrophobic material, such as silane, so that base web fibres 20 do not attach to surface 21.

Figure 6:
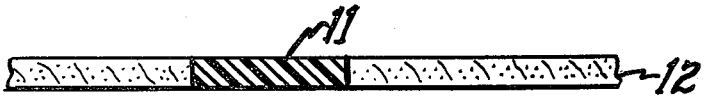
FIG. 6 is a side sectional view of the paper shown in FIG. 4.

FIG. 6 shows base paper web (12) with security device (11) integrally formed therein after carrier paper web (10) has become dispersed. The integral relationship between security device (11) and base paper web (12) is shown in FIG. 5 wherein the surface of security device (11) is coextensive with that of paper base web (12). However, if desired, security device (11) can be placed closer to or intentionally raised above the surface of the base paper web (12).

Figure 7:
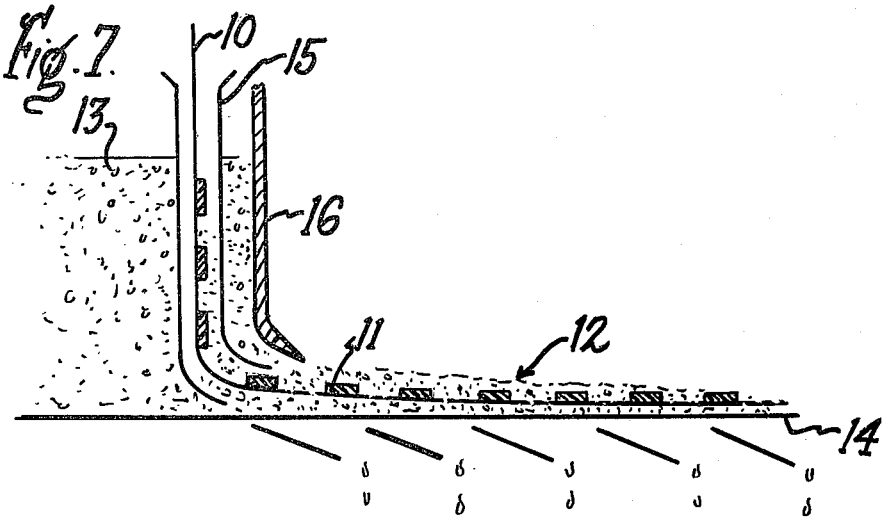
FIG. 7 is a side view of an apparatus used to introduce the carrier web containing the security devices into the typical Fourdrinier paper forming process according to the invention.

As shown in FIG. 7 security device (11) attached to carrier web (10) is placed within base fiber slurry (13) immediately before slice 16 on Fourdrinier section of a paper machine. Due to porous nature of carrier web (10), fibre slurry 13 drains through carrier web (10) depositing paper fibres above the carrier so that the carrier web (10) and attached security device (11) become embedded within the paper as in FIG. 5.

Figure 8:
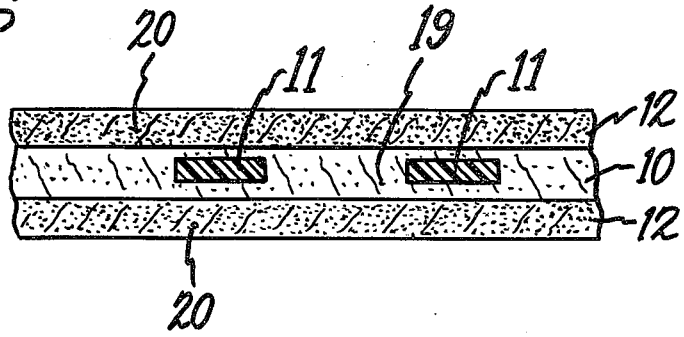
FIG. 8 is a cross section view of the finished paper with the dispersable carrier web containing security devices or distinctively treated fibres inserted therin.

FIG. 8 shows security device (11) within carrier web (10) having porous web fibres 19 that allow base paper fibres 20 to diffuse above and below carrier web (10) to deposit security devices (11) between two layers of paper web (12). This is accomplished by the apparatus shown in FIGS. 7 and 10.

Figure 9:
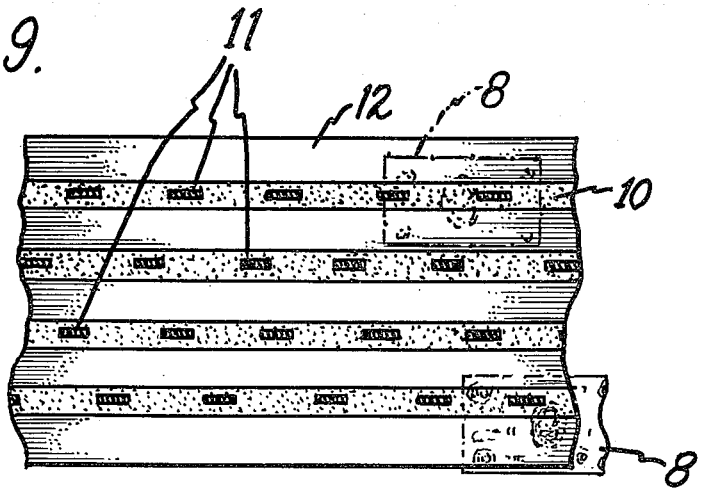
FIG. 9 shows a plan view of the paper as produced by a paper machine showing the security devices and the carrier web after insertion into the paper, localized as to position in the machine direction and the cross machine direction.

Although the earlier embodiments show carrier paper web (10) localized in the direction of base paper web (12), in some security applications, as in the case of in a localized currency, for example, it is beneficial to have security devices localized across the plane of base paper (12). This is accomplished as shown in FIG. 9 by having a plurality of spaced security devices (11), moving in the direction of base web (12) indicated by the directional arrow.

For purposes of illustration carrier paper web (10) is shown as a single item. However, in practice it is more convenient for carrier paper web (10) to comprise a continuous roll coextensive with base paper web (12) and carrying an adhesive layer on security device (11). Security device (11) is described as comprising diffraction grating structure made from a thin plastic film. Other types of security inserts can also be employed, such as decalomania, printed patterns, and colored fibres of both paper, metal and plastic material if so desired. After carrier paper web (10) has become dispersed tinin base paper web (12), security device (11) becomes integrally formed within base paper web (12). The use of a carrier paper web (12) to support security device (11) in the manner depicted in FIG. 1 allows very small security devices, such as microfilm, to be handled in a convenient manner and to be accurately positioned along base paper web (12) for identifying purposes, as described earlier.

Figure 10:
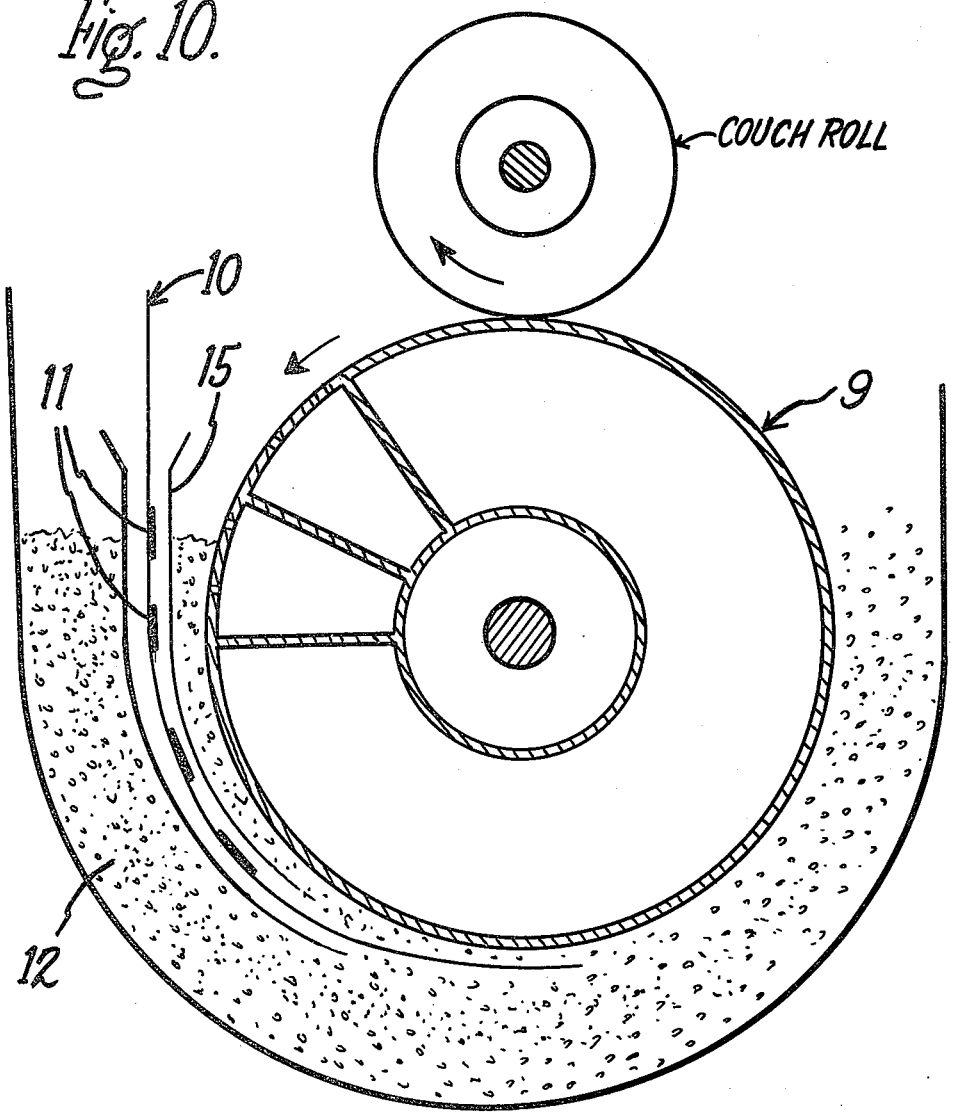
FIG. 10 is the side view of an apparatus used to introduce the carrier web containing the security devices into the typical cylinder mold paper forming process according to the invention.

FIG. 10 contains paper making cylinder mold 9 supporting base paper web (12) from slurry 13 into which carrier web (10) containing security devices (11) is continuously fed. Carrier web (10) is made from porous fibres 19, FIG. 5 so that base paper fibres 20 can readily diffuse through to position security devices (11) within base paper (12). When carrier web (10) is fabricated from a water dispersible paper, as described for the embodiment of FIG. 4, carrier web (10) then becomes dispersed leaving security devices (11) embedded within base paper web (12).

When base paper web (12) is used for currency, either one or several security devices (11) can be used to identify the currency as genuine. The use of one security device (11) within a currency bill 8 is shown in FIG. 9.

I claim:

1. A method for producing identifiable paper during the paper forming process on a paper making machine comprising the steps of:

attatching a security device consisting of a plastic film diffraction grating to one surface of a carrier web of water-dispersible paper;

positioning the carrier paper and security device relative to a predetermined position on a base paper web of less porous web density than said carrier web during the deposition and dewatering of said base paper web from a water suspension of said base paper fibers; and dispersing the carrier paper web to integrally join the security device to said one surface of the base paper.

2. A method of producing identifiable paper comprising the steps of:

depositing and dewatering a continuous web of base paper fibres from a water suspension of said base paper fibers;

providing a carrier paper web consisting of a plurality of water dispersible paper fibres having at least one security device consisting of a plurality of plastic or metal fibres having a hydrophobic coating on one surface to prevent the carrier web from adhering to said one surface;

inserting said carrier paper web relative to a predetermined position on said base paper web during the deposition and dewatering of said base paper web to disperse said carrier fibres and to cause said base paper fibres to integrally attatch said security device on said one surface of said base paper.

* * * * *